US006821364B2

(12) United States Patent
Cornet et al.

(10) Patent No.: US 6,821,364 B2
(45) Date of Patent: Nov. 23, 2004

(54) METHOD OF MAKING A MULTIPHASE HOT-ROLLED STEEL STRIP

(75) Inventors: Xavier Cornet, Ressaix (BE); Jean-Claude Herman, Blegny-Trembleur (BE)

(73) Assignee: Centre de Recherches Metallurgiques A.S.B.L., Brussels (BE)

( * ) Notice: Subject to any disclaimer, the term of this patent is extended or adjusted under 35 U.S.C. 154(b) by 0 days.

(21) Appl. No.: 10/221,170

(22) PCT Filed: Jan. 29, 2001

(86) PCT No.: PCT/BE01/00015

§ 371 (c)(1),
(2), (4) Date: Sep. 19, 2002

(87) PCT Pub. No.: WO01/71047

PCT Pub. Date: Sep. 27, 2001

(65) Prior Publication Data

US 2003/0041933 A1 Mar. 6, 2003

(30) Foreign Application Priority Data

Mar. 22, 2000 (BE) ..... 2000/0214

(51) Int. Cl.[7] ..... C22D 9/573

(52) U.S. Cl. ..... 148/661; 148/664; 148/638; 148/601

(58) Field of Search ..... 148/657, 638, 148/602, 601, 661, 664

(56) References Cited

U.S. PATENT DOCUMENTS 5,759,297 A * 6/1998 Teracher et al. ..... 148/320

FOREIGN PATENT DOCUMENTS

| | | | |
|---|---|---|---|
| DE | 19833321 | A1 | 1/2000 |
| EP | 0295500 | A1 | 12/1988 |
| EP | 0747495 | A1 | 12/1996 |
| EP | 0881306 | A1 | 12/1998 |

OTHER PUBLICATIONS

Patent Abstracts of Japan, vol. 5, No. 89, Jun. 10, 1981 & JP 56 033428 A (Sumitomo Metal Ind Ltd), Apr. 3, 1981.

Inoue et al, Cahiers D'Informations Techniques . . . , vol. 90, No. 3, Mar. 1, 1993, New Coiling Temperature . . . , pp. 403–409.

* cited by examiner

*Primary Examiner*—Deborah Yee
(74) *Attorney, Agent, or Firm*—Jacobson Holman PLLC

(57) ABSTRACT

The invention concerns a method for making a multiphase hot-rolled steel strip comprising an ultra-fast cooling operations, which consists in carrying out said ultra-fast cooling operation after controlled slow cooling of the strip on a conventional slow cooling table of the rolling mill. The controlled cooling constitutes a first slow cooling, at the output of the finishing mill, from an end-of-roll temperature to an intermediate temperature of about 750° C. to 500° C.; said first cooling determines the fraction of the first phase (ferrite) in the steel. The ultra-fast cooling (>150° C./s), which solidifies the resulting structure, lowers the temperature of the strip down to a coiling temperature, ranging between about 600° C. and room temperature, at which a second slow cooling is performed which results if the formation of the second phase (bainite or martensite).

6 Claims, No Drawings

METHOD OF MAKING A MULTIPHASE HOT-ROLLED STEEL STRIP

This is a national stage of PCT/BE01/00015, filed 29 Jan. 2001 and published in French.

TECHNICAL FIELD

The present invention relates to a method for making a multiphase hot-rolled steel strip having improved mechanical properties, in particular high strength and good ductility. Currently, such strips have a thickness of between 0.7 mm and 10 mm and more often between 2 mm and 6 mm.

PRIOR ART

High-strength steels have been known for a long time in the prior art and they have many different uses. In many cases, the mechanical properties of these steels result from appropriate thermal treatment, allowing in many cases to avoid having recourse to alloying elements, which are generally expensive.

However, certain applications require hot-rolled steel strips that have both high strength and good forming properties. Currently, such a combination of properties is extremely difficult to achieve and moreover is generally obtained only by means of multiphase steels such as steels with a ferrite/bainite or ferrite/martensite microstructure or by three-phase steels. In these steels, the ferrite forms the ductile and deformable element, while the second phase, bainite or martensite, strengthens the steel. The final mechanical properties of the steel are directly affected by the respective proportions of these phases and by the temperatures at which these are formed.

According to conventional practice, steels with a ferrite/bainite or ferrite/martensite microstructure are obtained from a specific chemical composition and by strict control of the cooling conditions during hot rolling. The microstructure and properties of these steels are affected by the coiling temperature and by the cooling rates to which the steels are subjected.

On a conventional laminar cooling table, it is not possible to control the cooling rate of the hot-rolled strip because the specific delivery rates of the cooling liquid are fixed. This cooling rate will therefore largely depend on the speed and thickness of the strip and on external parameters such as the temperature of the cooling liquid. In particular, it varies over the length of the strip owing to the increase in the speed of the latter due to the acceleration of the rolling mill between the beginning and the end of a strip. As is known, this acceleration is imposed by the need to maintain a constant end-of-roll temperature for the entire strip. This results in uncertainty as to the cooling rate of the steel, which has repercussions for the microstructure and hence properties of the strip and may ultimately be translated into costly strip cropping and degradation.

Moreover, the chemical composition of the steel must be adapted as a function of the microstructures to be achieved and likewise as a function of the cooling which might be applied. In these conditions, it is virtually impossible to vary the composition of the steel in a specific way in order to improve certain mechanical properties, such as fatigue resistance or resistance to ageing, capacity for hole expansion, or indeed suitability for welding or surface quality.

It is furthermore known that it is possible to produce multiphase steels by a cooling treatment referred to as interrupted-cycle treatment. In general terms, such treatment initially comprises a first step, in which the strip is maintained at a high temperature to ensure partial transformation of the austenite into ferrite, followed by abrupt cooling intended to solidify the partially transformed microstructure, and finally a second step, in which the temperature is maintained at a lower level to transform the rest of the austenite into bainite or into martensite. In conventional strip mills, the cooling tables do not however have cooling sections that are powerful enough to ensure abrupt cooling of this kind.

In this regard, an ultra-fast cooling method (UFC) is indeed known, applied to a hot-rolled strip immediately after it emerges from the finishing mill. This ultra-fast cooling is followed by slow cooling, referred to as laminar cooling, on the conventional cooler leading to the coilers. This method does, of course, allow to obtain steels with a high elastic limit, e.g. steels containing dispersoids. However, such steels have a lower ductility than that developed by multiphase structures, preventing them from being used for applications that require one or more forming operations.

PRESENTATION OF THE INVENTION

The present invention aims to propose a method for making a multiphase hot-rolled steel strip which has mechanical properties, in particular strength and ductility, that are improved compared to the above-mentioned prior art.

According to the present invention, a method for making a multiphase hot-rolled steel strip, which comprises an ultra-fast cooling operation, is characterised in that said ultra-fast cooling operation is carried out after slow laminar cooling of the strip on the cooling table and before the final coiling of the strip.

In hot-strip mills, the end-of-roll temperature of the strips is equal to or greater than the Ar3 transformation temperature; of course, this temperature varies as a function of the composition of the steel but it is generally between about 800° C. and 900° C.

According to the invention, the hot-rolled steel strip is subjected, on emerging from the finishing mill, to a first slow cooling operation from the end-of-roll temperature to a temperature referred to as the intermediate temperature, between about 750° C. and 500° C., preferably between 750° C. and 600° C., then to an ultra-fast cooling operation from said intermediate temperature to a temperature referred to as the coiling temperature, between about 600° C. and room temperature, and finally to a second slow cooling operation from said coiling temperature to room temperature.

The first cooling operation preferably takes place on the conventional laminar cooling table, i.e. with water at a low cooling rate; however, it can also be carried out with air. It thus forms the first step in which the strip is maintained at a high temperature, during which the ferrite can form in conditions close to equilibrium. The duration of this first cooling operation depends on the speed of the strip and on the cooling rate applied, as a function of the degree of transformation desired and hence of the intermediate temperature intended. The cooling rate being low in all cases, it is not influenced to any significant extent by the effect of the acceleration of the mill.

The abrupt cooling operation is then preferably carried out by the ultra-fast cooling method mentioned above. It may be recalled here that this ultra-fast cooling consists in spraying the strip with jets of water under a pressure of 4 to 5 bar; this cooling can be regulated in terms of cooling rate and temperature by means of the water delivery rate and the length sprayed. It allows to achieve cooling rates of 5 to 10 times greater than conventional laminar cooling tables. Said ultra-fast cooling operation is preferably carried out at a cooling rate such that the product of the thickness of the strip in mm and the cooling rate in ° C./s is greater than 600, and preferably greater than 800. By way of illustration, the ultra-fast cooling operation mentioned above is advantageously carried out at a cooling rate greater than 150° C./s on a 4-mm thick strip.

Finally, the second slow cooling operation is carried out immediately after the abrupt cooling operation, i.e. essentially during the coiling of the strip. This cooling operation takes place from the coiling temperature to a temperature at which there is no more transformation of the microstructure, i.e. in practice to room temperature. In the course of this slow cooling operation, the residual austenite is generally transformed to form the second phase, bainite or martensite, as a function of the coiling temperature. However, in certain cases, this transformation may take place before the slow cooling operation, i.e. during the abrupt cooling operation.

For the practical implementation of the invention, the respective proportions of the phases required in the steel are first of all determined as a function of the desired properties; the duration of the first slow cooling operation and the intermediate temperature leading to the required fraction of the first phase are deduced therefrom; the coiling temperature leading to the required second phase is likewise deduced therefrom; finally, said values for duration and temperature are applied for the respective regulation of the first slow cooling and the ultra-fast cooling stages.

EXAMPLES

By way of example, the method according to the invention has been applied to a first series of steel grades, the chemical compositions of which are given in Table 1.

TABLE 1

| | Chemical composition (without precipitation) Chemical Composition ($10^{-3}$%) | | | | | | |
|---|---|---|---|---|---|---|---|
| Grade | C | Mn | Si | Al | N | Nb | Ti |
| 1 | 144 | 996 | 7 | 32 | 4 | 0 | 1 |
| 2 | 67 | 760 | 4 | 31 | 3 | 48 | 30 |
| 3 | 80 | 1448 | 122 | 27 | 5 | 32 | 1 |

In conventional practice, steel 1 can lead to a dual-phase microstructure (ferrite/bainite but not ferrite/martensite). Steel 2 will not form a multiphase microstructure owing to the high contents of niobium and titanium, which cause a very rapid transformation of the austenite into ferrite and pearlite, thereby counteracting the formation of bainite and/or martensite. Finally, steel 3 allows in principle the formation of a dual-phase microstructure (ferrite/martensite) thanks to its high manganese contents and a carefully chosen thermomechanical cycle. However, such a transformation is only accomplished with difficulty on the laminar cooling table and entails a significant reduction in the productivity of the hot-rolling mill.

These three steels were subjected to a treatment cycle according to the invention, the of which are indicated in Tables 2 and 3 for steels with a ferrite/bainite (Table 2) and a ferrite/martensite or dual-phase microstructure (Table 3) respectively. These two tables likewise show the properties and fractions of the second phase of the steels considered.

TABLE 2

| | Ferrite/bainite steels | | | | | | | | | |
|---|---|---|---|---|---|---|---|---|---|---|
| Grade | Rolling temperature | Intermediate temperature | Coiling temperature | YS Elastic limit | TS Breaking load | Uniform elongation | Total elongation T.El (L0 = 50 mm) | YS/TS | TS * T.El | Bainite fraction |
| 1 | 830° C. | 715° C. | 550° C. | 331 | 467 | 17 | 29 | 0.71 | 13707 | 45% |
| 2 | 890° C. | 712° C. | 600° C. | 455 | 508 | 15 | 29 | 0.90 | 14466 | 10% |
| 2 | 890° C. | 745° C. | 550° C. | 456 | 523 | 14 | 26 | 0.87 | 13779 | 25% |
| 3 | 870° C. | 670° C. | 550° C. | 475 | 549 | 15 | 26 | 0.86 | 14287 | ~30% |
| 3 | 870° C. | 700° C. | 600° C. | 480 | 556 | 12 | 23 | 0.86 | 12501 | ~40% |
| 1 | 840° C. | 715° C. | 275° C. | 381 | 585 | 12 | 23 | 0.65 | 13368 | 45% |
| 3 | 870° C. | 670° C. | 350° C. | 515 | 632 | 10 | 20 | 0.81 | 12649 | 60% |

This Table 2 shows that it is possible to obtain multiphase microstructures with improved properties of strength and ductility from each of these three grades of steel. This result is obtained by careful choice and adequate control of the intermediate temperature and the coiling temperature. The choice of coiling temperature allows to regulate the fraction of ferrite transformed and, consequently, also the fraction of the second phase; that of the coiling temperature allows to determine the nature of this second phase (bainite or martensite). If this coiling temperature is carefully chosen, it can likewise allow the appearance of a third phase. This is the case, in particular, between 200° C. and 350° C., where a fraction of martensite may appear within a ferrite/bainite microstructure.

TABLE 3

| Dual-phase steels | | | | | | | | | | |
|---|---|---|---|---|---|---|---|---|---|---|
| Grade | Rolling temperature | Intermediate temperature | Coiling temperature | YS Elastic limit | TS Breaking load | Uniform elongation | Total elongation T.El (L0 = 50 mm) | YS/TS | TS * T.El | Martensite fraction |
| 2 | 900° C. | 660° C. | Room | 515 | 695 | 11 | 18 | 0.74 | 12453 | 5% |
| 3 | 870° C. | 660° C. | Room | 430 | 706 | 11 | 18 | 0.61 | 12824 | 45% |
| 2 | 900° C. | 690° C. | Room | 532 | 711 | 11 | 16 | 0.75 | 11517 | 10% |
| 3 | 870° C. | 630° C. | Room | 450 | 743 | 13 | 19 | 0.61 | 14119 | 15–20% |
| 1 | 830° C. | 665° C. | Room | 459 | 783 | 10 | 15 | 0.59 | 11648 | 17% |
| 3 | 870° C. | 707° C. | 100° C. | 496 | 812 | 11 | 20 | 0.61 | 16240 | 60% |
| 3 | 870° C. | 707° C. | Room | 507 | 839 | 10 | 16 | 0.61 | 13277 | 60% |
| 1 | 830° C. | 715° C. | Room | 488 | 856 | 10 | 13 | 0.57 | 10877 | 35% |

Table 3 shows that ultra-fast cooling of these same steels to a coiling temperature equal to room temperature leads to the formation of martensite and, consequently, to increased strength while preserving good ductility. The coiling temperature of 100° C. corresponds to slight reheating of the strip after cooling, which does not prejudice its strength and even slightly improves its ductility.

In a second example, micro-alloyed steels were likewise subjected to a cycle of treatment according to the invention. Their chemical compositions are given in table 4.

TABLE 4

| Chemical composition (with precipitation) Chemical composition ($10^{-3}$%) | | | | | | | |
|---|---|---|---|---|---|---|---|
| Grade | C | Mn | Si | Al | N | Nb | Ti |
| 4 | 80 | 1000 | | | | 30 | 100 |
| 5 | 80 | 1500 | | | | 30 | 100 |

The cooling schemes are indicated in Tables 5 and 6 for steels with a ferrite/bainite microstructure (Table 5) and a ferrite/martensite microstructure (Table 6) respectively. Such cooling schemes in accordance with the invention enable the hardening of the steels by precipitation of micro-alloying elements (Ti) in the form of carbides. Such precipitation is generally impossible in a conventional multiphase steel because it requires a first, very slow cooling operation (<20° C./s) at high temperature (>600° C.).

Tables 5 and 6 likewise show the properties of strength and ductility obtained with these steels.

TABLE 5

| Ferrite/bainite steels | | | | | | | | | | |
|---|---|---|---|---|---|---|---|---|---|---|
| Grade | Rolling temperature | Intermediate temperature | Coiling temperature | YS Elastic limit | TS Breaking load | Uniform elongation | Total elongation T.El (L0 = 50 mm) | YS/TS | TS * T.El | Bainite fraction |
| 4 | | 640° C. | 450° C. | 547 | 606 | 14 | 23 | 0.9 | 13938 | |
| 5 | | 650° C. | 450° C. | 650 | 706 | 11 | 21 | 0.92 | 14826 | |

TABLE 6

| Dual-phase steels | | | | | | | | | | |
|---|---|---|---|---|---|---|---|---|---|---|
| Grade | Rolling temperature | Intermediate temperature | Coiling temperature | YS Elastic limit | TS Breaking load | Uniform elongation | Total elongation T.El (L0 = 50 mm) | YS/TS | TS * T.El | Martensite fraction |
| 4 | | 650° C. | Room | 539 | 743 | 12 | 21 | 0.73 | 15603 | |
| 5 | | 650° C. | Room | 601 | 853 | 10 | 17 | 0.7 | 14501 | |

The method according to the invention offers several significant advantages over the prior art.

Firstly, it allows better control over the formation of microstructures, namely the fraction of ferrite, on the one hand, and the fraction and nature of the second phase, on the other hand. The microstructures of the two phases are in fact obtained by two totally independent cooling operations, which enable to manage and regulate the temperatures leading to the desired microstructures separately.

The first of these two cooling operations is carried out on the laminar cooling table, starting from the end-of-roll temperature. Since the cooling rate is not very high here, it is not very critical and is scarcely influenced by the effect of acceleration of the rolling mill. This operation allows to regulate the percentage of ferrite formed by varying the cooling conditions, in particular the number of sections which are sprayed, i.e. in fact the duration of cooling, to obtain the desired intermediate temperature.

The second cooling operation is an abrupt cooling operation, preferably ultra-fast, to the coiling temperature corresponding to the desired microstructure of the second phase, whether this is bainite or martensite. The effect of this cooling is to solidify the microstructure formed in the course of the first slow cooling operation so as to allow the transformation to resume at the coiling temperature.

The microstructures being controlled by means of the temperatures of the treatment cycle, it is consequently possible to obtain different mechanical properties starting from the same grade of steel. The method according to the invention likewise allows to create multiphase microstructures and to give interesting properties to grades of steel that had not previously been intended for this purpose.

Moreover, the method according to the invention is no longer limited to a limited number of specific chemical compositions to obtain the desired microstructures. Indeed, these microstructures no longer depend on the chemical composition of the steel but are the outcome of numerous ways of combining the slow laminar cooling and the abrupt cooling which follows it. It is consequently possible to adapt the chemical composition of steels more easily to improve their mechanical properties, such as resistance to fatigue or ageing, suitability for welding or hole expansion, surface quality or suitability for cutting. It can likewise result in a reduction of the costs of steel production which are linked, for example, to a drop in productivity or to operations such as the repairing of cracks or descaling.

What is claim is:

1. A method for making a mutliphase hot-rolled steel strip comprising the step of carrying out an ultra-fast cooling operation, which comprises a spraying of the strip with water jets under a pressure of 4 to 5 bar, keep a slow laminar cooling of the strip on a cooling table and before a final cooling of the strip, and at such a cooling rate that the product of the thickness of the strip in mm multiplied by ° C./s is greater than 600.

2. The method according to claim 1, wherein, on emerging from a finishing mill, the hot-rolled steel strip is subjected to a first slow cooling operation from an end-of roll temperature to a temperature referred to as an intermediate temperature, between about 750° C. and 500° C., then to an ultra-fast cooling operation from said intermediate temperature to a temperature referred to as a coiling temperature, between about 600° C. and room temperature, and finally to a second slow cooling operation from said coiling temperature.

3. The method according to claim 2, wherein the intermediate temperature is between about 750° C. and 600° C.

4. The method according to claim 1, wherein said first slow cooling operation is carried out on a conventional laminar cooling table arranged downstream of a finishing mill.

5. The method according to claim 1, wherein said ultra-fast cooling operation is carried out at such a cooling rate that the product of the thickness of the strip in mm and the cooling rate in ° C./s is greater than 800.

6. The method according to claim 1, wherein the respective proportions of the phases required in the steel are determined; the duration of a first slow cooling operation and an intermediate temperature leading to the required fraction of a first phase are deduced therefrom; a coiling temperature leading to a required second phase is likewise deduced therefrom; and, said values for duration and temperature are applied for the respective regulation of the first slow cooling operation and of the ultra-fast cooling operation.

* * * * *